US008925253B2

(12) United States Patent
Bullinger

(10) Patent No.: US 8,925,253 B2
(45) Date of Patent: Jan. 6, 2015

(54) GUTTER AND COVER SYSTEM

(75) Inventor: Michael J. Bullinger, Fargo, ND (US)

(73) Assignee: Eastside Machine Company, Inc., Fargo, ND (US)

( * ) Notice: Subject to any disclaimer, the term of this patent is extended or adjusted under 35 U.S.C. 154(b) by 2672 days.

(21) Appl. No.: 10/697,788

(22) Filed: Oct. 30, 2003

(65) Prior Publication Data

US 2004/0244304 A1 Dec. 9, 2004

Related U.S. Application Data

(63) Continuation-in-part of application No. 10/286,414, filed on Oct. 31, 2002, now abandoned.

(51) Int. Cl.
*E04D 13/064* (2006.01)
*E04D 13/076* (2006.01)
*E04D 13/00* (2006.01)

(52) U.S. Cl.
CPC ..... *E04D 13/076* (2013.01); *E04D 13/064* (2013.01); *E04D 13/00* (2013.01); *E04D 13/0641* (2013.01)
USPC ..... 52/12; 52/11; 52/15; 52/13

(58) Field of Classification Search
CPC . E04D 13/076; E04D 13/064; E04D 13/0727; E04D 13/072; E04D 13/0641
USPC ..... 52/11, 12, 15, 13; 248/48.1, 48.2
See application file for complete search history.

(56) References Cited

U.S. PATENT DOCUMENTS

| | | | | | |
|---|---|---|---|---|---|
| 2,201,320 | A | * | 5/1940 | Place | 52/25 |
| 2,505,241 | A | | 4/1950 | Gray et al. | |
| 2,672,832 | A | * | 3/1954 | Goetz | 52/12 |
| 4,263,756 | A | * | 4/1981 | Middleby | 52/11 |
| 4,604,837 | A | * | 8/1986 | Beam | 52/12 |
| 4,667,448 | A | * | 5/1987 | Smith | 52/12 |
| 4,769,957 | A | * | 9/1988 | Knowles | 52/12 |
| 4,899,566 | A | | 2/1990 | Knudson | |
| 5,072,551 | A | * | 12/1991 | Manoogian, Jr. | 52/12 |
| 5,189,849 | A | | 3/1993 | Collins | |
| 5,406,754 | A | * | 4/1995 | Cosby | 52/12 |
| 5,519,969 | A | * | 5/1996 | Golba | 52/60 |
| 5,575,118 | A | | 11/1996 | Vahldieck | |
| 5,729,931 | A | * | 3/1998 | Wade | 52/12 |
| 5,740,633 | A | * | 4/1998 | Champagne | 52/11 |
| 5,845,435 | A | * | 12/1998 | Knudson | 52/11 |

(Continued)

FOREIGN PATENT DOCUMENTS

| | | | | |
|---|---|---|---|---|
| JP | 6-307035 | * | 11/1994 | 52/11 |
| JP | 6-307036 | * | 11/1994 | 52/11 |

*Primary Examiner* — Phi A
(74) *Attorney, Agent, or Firm* — Merchant & Gould PC

(57) ABSTRACT

A gutter and cover system mounts at an edge of a roof to collect water into the gutter without other debris. The system includes a combination gutter and cover made from a monolithic element or interlocked to form a single structure. The gutter includes a front, bottom and rear extending up to the cover, which extends over the gutter. The cover has a pooling section and a front, curving edge. The pooling section slows down the flow of water and allows it to flow over the curving edge and adhere to the cover due to surface tension while debris falls outside of the gutter. A support element slides inward to provide support for the cover and a front face of the gutter. The support element includes structure for receiving mounting hardware.

1 Claim, 9 Drawing Sheets

(56) References Cited

U.S. PATENT DOCUMENTS

| | | | | | |
|---|---|---|---|---|---|
| 5,924,898 | A * | 7/1999 | Dutton et al. | 439/701 |
| 5,953,861 | A * | 9/1999 | Podgwaite | 52/11 |
| 5,956,904 | A * | 9/1999 | Gentry | 52/12 |
| 6,050,030 | A * | 4/2000 | Wax, Sr. | 52/15 |
| 6,098,344 | A | 8/2000 | Albracht | |
| 6,098,345 | A * | 8/2000 | Demartini et al. | 52/12 |
| 6,470,628 | B1 * | 10/2002 | Walters | 52/12 |
| 6,598,352 | B2 * | 7/2003 | Higginbotham | 52/12 |
| 6,732,477 | B1 * | 5/2004 | Richard | 52/12 |
| 2002/0152692 | A1 | 10/2002 | Bahroos et al. | |
| 2005/0028452 | A1 * | 2/2005 | Brochu | 52/12 |

* cited by examiner

GUTTER AND COVER SYSTEM

FIELD OF THE INVENTION

The present invention relates to a gutter and cover system such as is used at the edge of a roof, and in particular to a gutter and cover system with a singly formed gutter and cover structure.

DESCRIPTION OF THE PRIOR ART

Gutters are used on a majority of dwelling houses and other buildings to redirect water to a down pipe, which then directs the run-off to a more convenient disposal location. This avoids splashing, "trenching", flooding, and other such nuisances. However, a persistent problem with such gutters is that they collect leaves, sticks, pine needles and other debris, which causes the gutters and/or down pipes to become blocked. As a result, water can back up and flood over the gutter edge and sometimes down the side of a building. Gutters blocked by debris can also cause devastating consequences during the winter months by not allowing melting snow and ice to properly drain off the roofs of buildings. During melting and refreezing cycles, this blocked water can then refreeze and act as a dam to the snow, which can continue to melt and leak into the interior of the building.

To cure this deficiency and alleviate the necessity for manually cleaning out gutters and/or down pipes, various systems have been made. Such systems include screen devices that cover the gutter opening to deflect debris from going into the gutter. However, instead of deflecting the debris, such screen devices instead cause an accumulation of debris, which still must be manually removed over a period of time. Other proposals have been made to utilize surface tension to direct the water into the gutter, while the leaves and other debris carried by the water is jettisoned off to the ground. It has been found, however, that surface tension of the water is often not sufficient to contain the water flow against certain counter-forces, such as large volumes of water. To cure this deficiency, proposals have been made to add measures for interrupting the flow of water, such as ribs, to the covers of gutters to slow the water, allowing the surface tension to direct debris-free water into the gutter. Although such measures do increase the effectiveness of surface tension, they still fail to satisfactorily alleviate the above problem. Further, gutter devices utilizing the surface tension to direct water and debris consist of at least two separate parts, a gutter and a cover over the gutter.

Earlier gutter devices utilizing the surface tension of water to separate water from leaves and other debris fail at effectively directing the debris-free water into the gutter portion of the devices. A system is needed that deflects leaves and other debris while effectively capturing and retaining the debris-free water within the gutter portion of the system. Such a gutter and cover system should be structurally simpler and easier to install and manufacture than the prior gutter devices.

SUMMARY OF THE INVENTION

The present invention is directed to a gutter and cover system for an edge of a roof. The present invention combines the cover with the gutter in a single interlocked structure. The configuration of the gutter may take on several embodiments, but generally includes a front face that may have a lip at an upper end thereof extending down to a gutter bottom and rear. The rear of the gutter extends upward and forms a flange. The flange extends above the cover, which extends outward forward from the flange. The cover forms a pooling section and a front curving section that extends under the cover and rearward above the gutter.

The pooling section receives rain falling from the roof and slows the speed of the water, dispersing kinematic energy. As the water pools, it fills the pooling section and flows over the front edge of the cover. Surface tension causes the slowed water to cling to the curving section and flow downward and rearward to drop off into the gutter. Debris falls over the front edge of the cover and is separated from the water so that it does not enter the gutter. In this manner, the gutter receives the rain while debris falls outside of the gutter and lessens the need for cleaning the gutter. A flange provides a stop or backsplash and aids in alignment for mounting at an edge of the roof.

A support element inserts into the combination cover and gutter. The support element extends upward to the underside of the cover and forward to the curving section in a preferred embodiment. A second arm of the support element extends downward under the front lip of the front face of the gutter. This forward element extends rearward to engage the rear portion of the gutter. The support element includes an orifice extending there through receiving mounting hardware, such as screws, bolts or nails that extends through the rear portion of the gutter and into a fascia of the building or roof edge. A typical system includes multiple support elements spaced at intervals along the edge of the roof. A typical distance may be approximately two feet, the distance depending upon the climate, roof construction and other design needs.

In a first embodiment of the application, the gutter includes a K-style profile. In other embodiments, the gutter includes a more squared front face and may have a slight angle relative to the vertical and horizontal orientation relative to horizontal and vertical. In a further embodiment, the front face of the gutter includes a continuously arcing profile. Each of these configurations includes the gutter and cover made from a single element and is preferably monolithic. Typical materials include aluminum and steel and thickness may run in the neighborhood of 3/100 of an inch.

The cover and gutter system is made with a machine that forms a unitary cover and gutter or interlocks the cover to the gutter and then cuts to length, achieving a seamless structure. This allows for forming gutters, covers, or gutter and cover systems.

These features of novelty and various other advantages that characterize the invention are pointed out with particularity in the claims annexed hereto and forming a part hereof. However, for a better understanding of the invention, its advantages and the objections obtained by its use, reference should be made to the drawings that form a further part hereof, and to the accompanying descriptive matter, in that there is illustrated and described a preferred embodiment of the invention.

DETAILED DESCRIPTION OF THE PREFERRED EMBODIMENT

Figure 1:
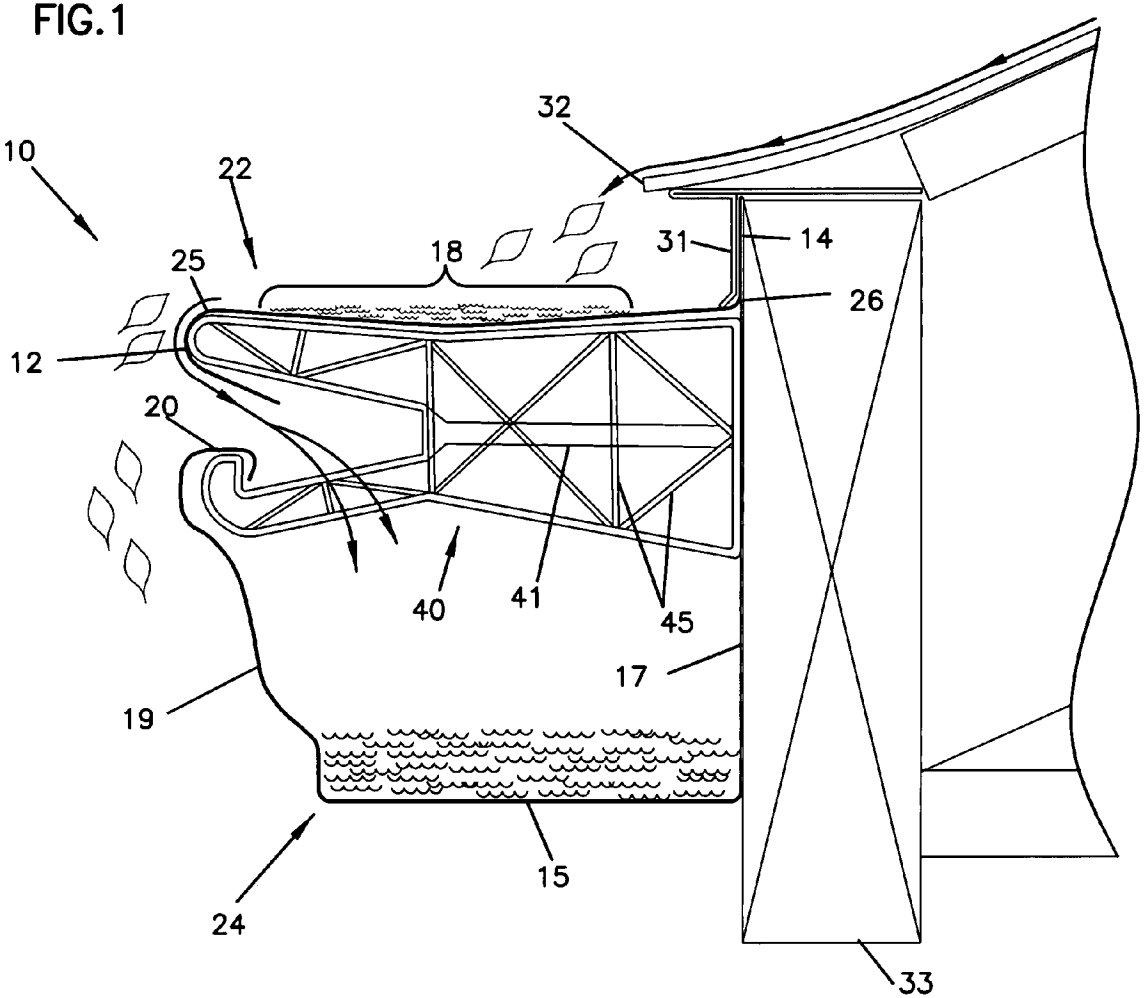
FIG. 1 is an end view of a first embodiment of a gutter and cover system according to the principles of the present invention mounted to the edge of the roof.
Figure 2:
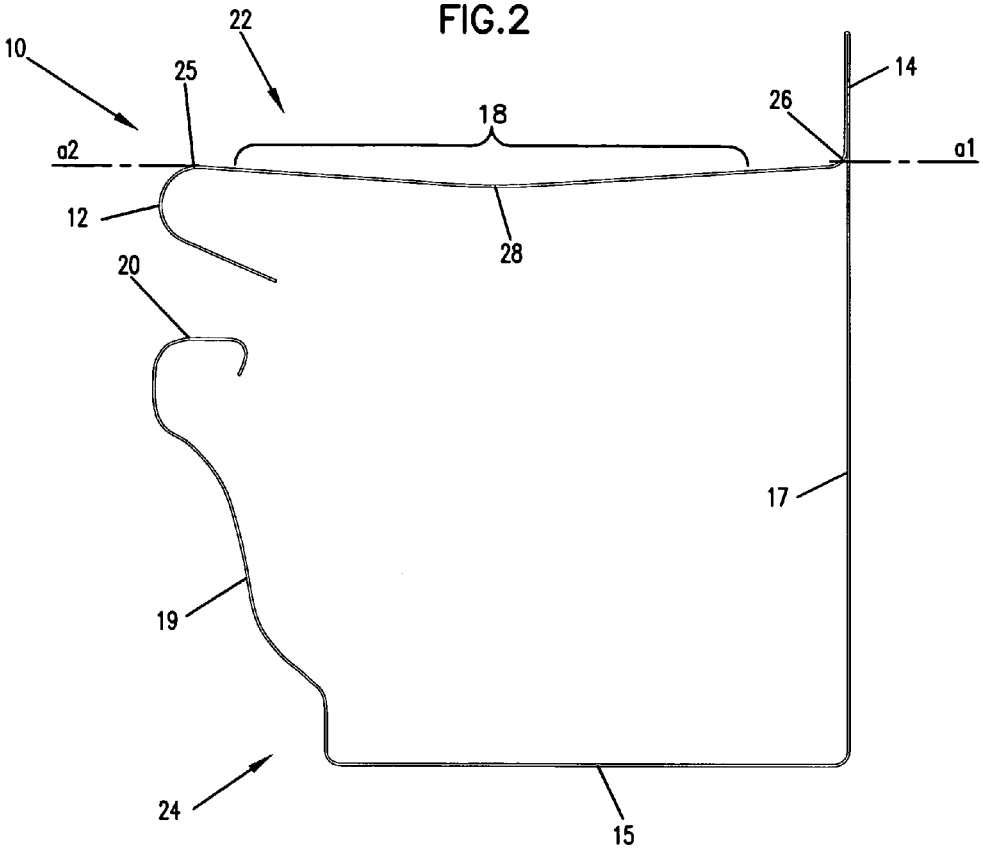
FIG. 2 is an end view of an integral gutter and cover for the system shown in FIG. 1.

Referring now to the Figures, FIG. 1 illustrates an end view of a gutter and cover system 10 for mounting under an edge 32 of a roof 30 of building or structure 33. In accordance with the present invention, the gutter and cover system 10 is typically rolled from a monolithic sheet of blank material in a first embodiment, preferably a metal material such as aluminum having a uniform wall thickness, with a typical thickness being about 0.032 inches. It can also be appreciated by those skilled in the art that other suitable materials such as steel and alloys and having different material thicknesses may be used, depending on the particular application. FIGS. 1 and 2 show the gutter and cover system 10 including a cover portion 22 and a gutter portion 24 integrally connected by a rear wall 17. In one embodiment, the rear wall 17 continues approximately 1 inch above the cover portion 22, forming a flange or extension 14 positioned under a drip edge of the structure 33 to prevent water flowing off the roof from splashing back onto the roof or the structure 33. The gutter portion 24 includes a gutter bottom 15 that integrally connects the rear wall 17 to a front wall 19. The gutter bottom 15 is shown in the Figures with a flat surface. However, it is readily understood by those skilled in the art that it may be rounded to collect water at the center or shaped to collect water closer to the front or back area of the gutter portion 24. The front wall 19 extends upward toward the cover portion 22, preferably concludes by extending rearward and downward to form a lip portion 20.

Figure 4:
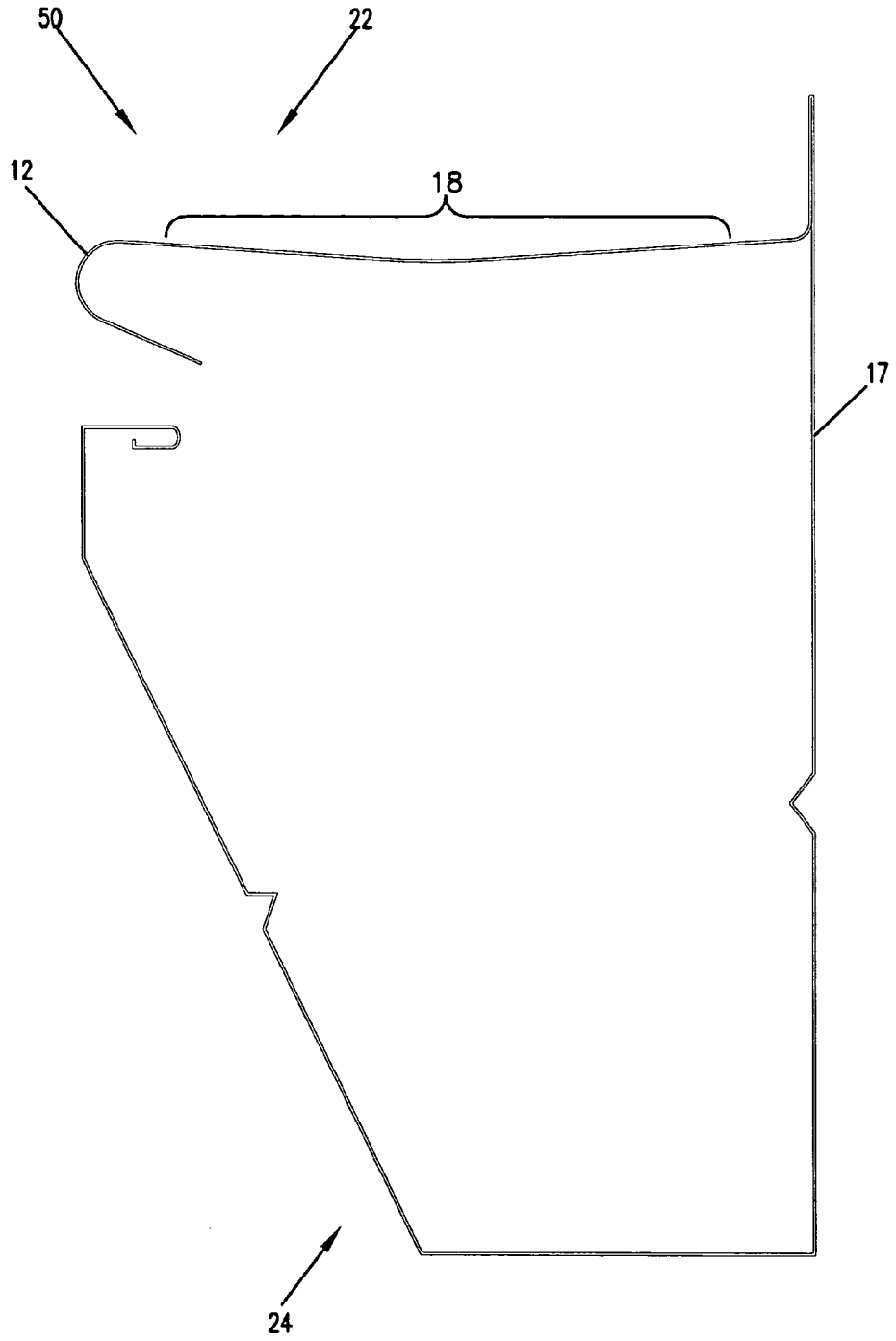
FIG. 4 is a side elevational view of a second embodiment of an integral gutter and cover for the system shown in FIG. 1.
Figure 5:
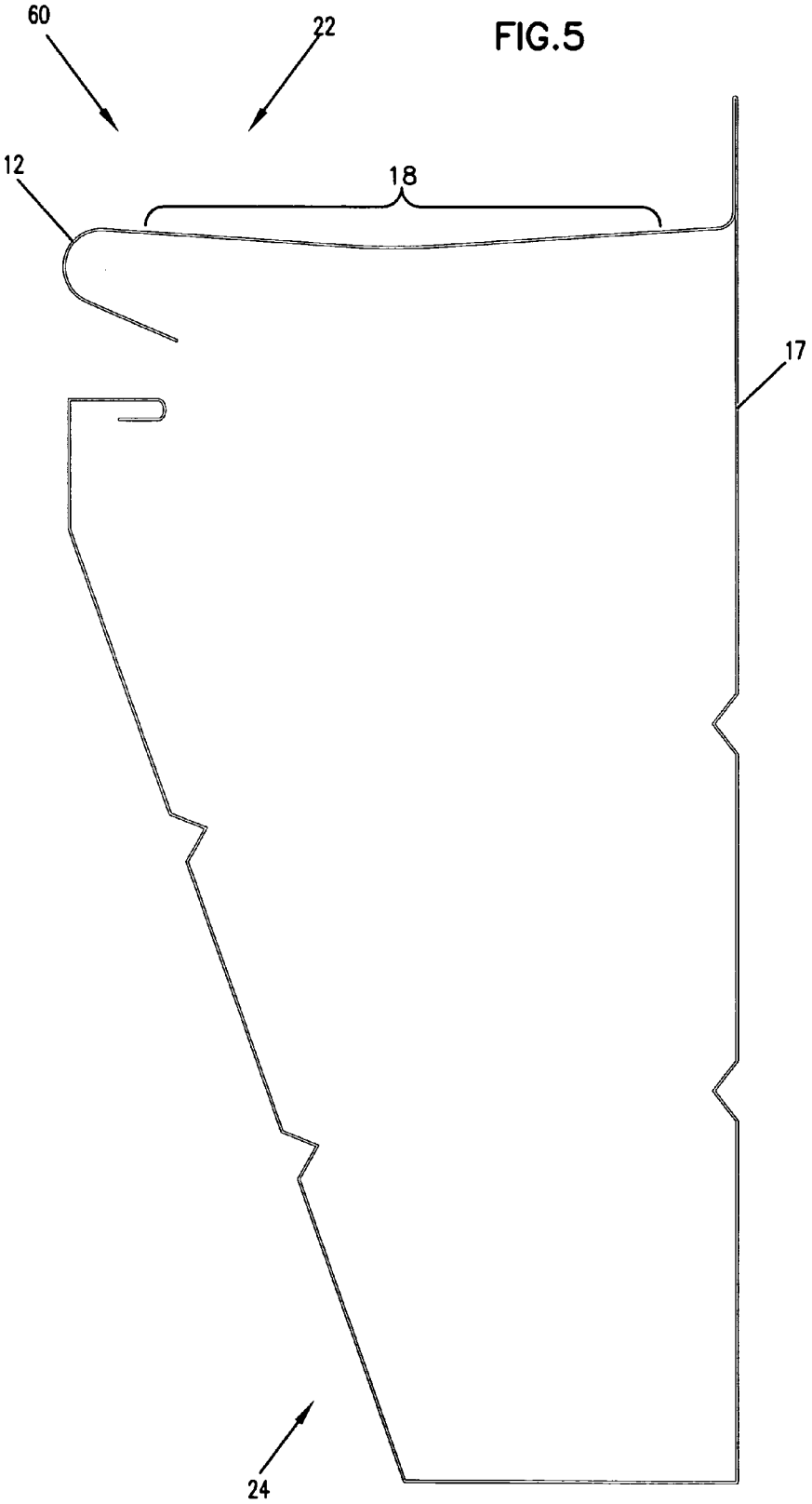
FIG. 5 is a side elevational view of a third embodiment of an integral gutter and cover for the system shown in FIG. 1.
Figure 6:
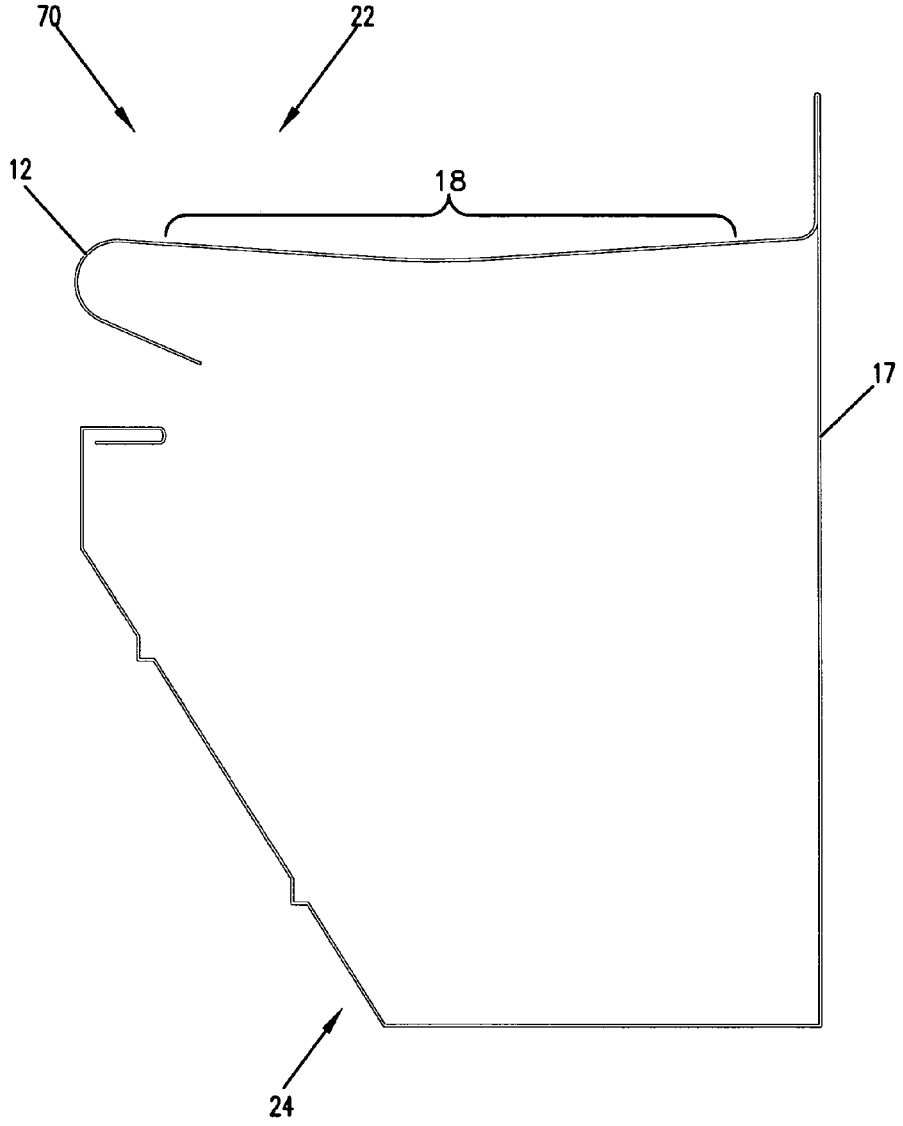
FIG. 6 is a side elevational view of a fourth embodiment of an integral gutter and cover for the system shown in FIG. 1.
Figure 7:
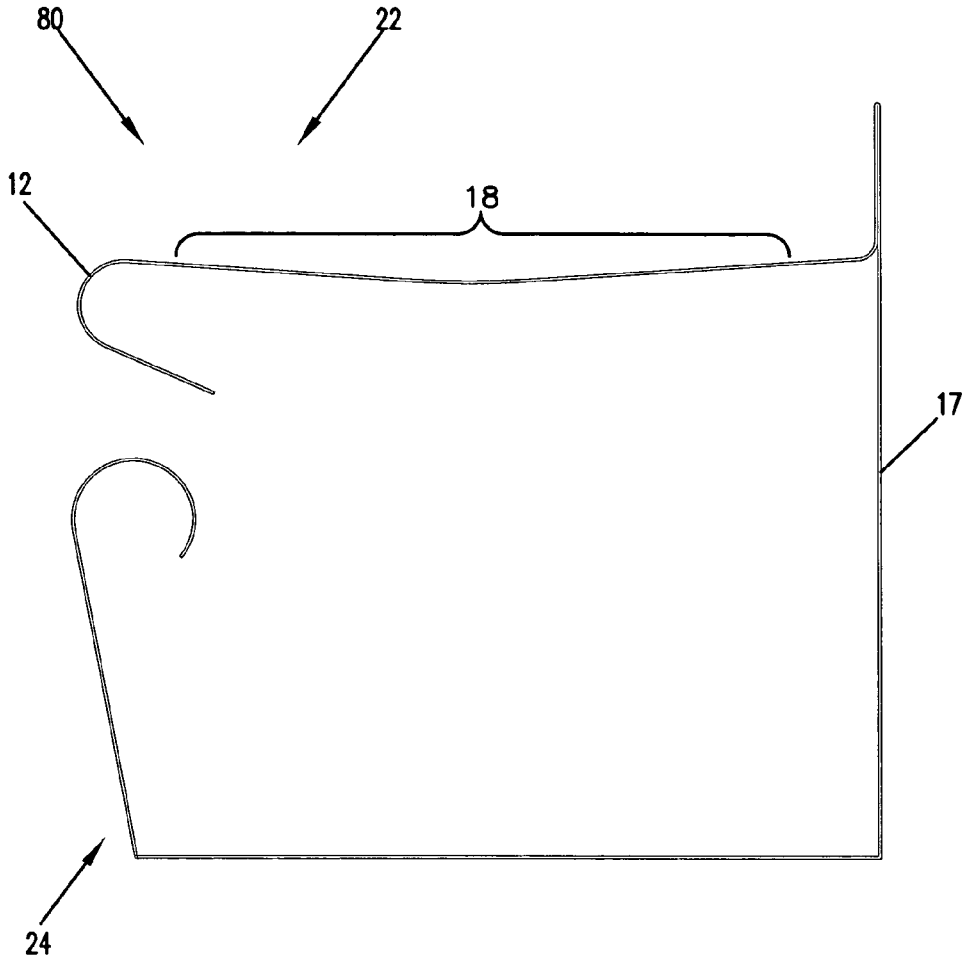
FIG. 7 is a side elevational view of a fifth embodiment of an integral gutter and cover for the system shown in FIG. 1.

FIGS. 4-7 illustrate alternate embodiments of the gutter and cover system, and are generally designated 50, 60, 70 and 80 respectively. The front wall 19 may define a number of different profile embodiments including, but not limited to, an Ogee profile, illustrated in FIG. 1, a continuously curved profile, illustrated in FIG. 7, or various straight profiles, as illustrated in FIGS. 4-6.

The cover portion of the present invention extends from and is integrally connected with the rear wall 17 in one embodiment. Extending generally over the gutter portion 24, the cover portion 22 concludes by curving downward and rearward to form a debris separation portion 12. The debris separation portion 12 has at least a minimum radius to provide sufficient surface tension such that water clings to the debris separation portion 12 and flows behind the lip portion 20, and drops into the gutter portion 24, while debris is jettisoned off the system, thereby separating the water, which is directed into the gutter, and the debris. Intermediate the rear wall 17 and the debris separation portion 12, the cover portion 22 includes a kinetic energy dispersion section 18. As shown in FIG. 2, the kinetic energy dispersion section 18 functions as a pooling section and preferably begins at the intersection 26 of the rear wall 17 and the cover portion 22 and ends at the top 25 of the debris separation portion 12. In a preferred embodiment, the low point 28 of the kinetic energy dispersion section 18 is equal distance from the intersection 26 of the rear wall 17 and the cover portion 22, and the top 25 of the debris separation portion 12. In alternate embodiments, the low point of the kinetic energy dispersion section may be positioned in a variety of locations along the kinetic energy dispersion section 18. As shown in FIG. 2, the low point of the kinetic energy dispersion section 18 is located below both a horizontal axis, a1, tangent to intersection 26 and a horizontal axis, a2, tangent the top 25 of the debris separation portion 12, causing the water flowing over the cover portion 22 to pool and lose kinetic energy before flowing over the debris separation portion 12 and into the gutter portion 24. By dispersing the kinetic energy of the flowing water, the kinetic energy dispersion section allows the surface tension properties of the water to effectively direct the slowly flowing water over the debris separation portion 12 and into the gutter portion 24.

Figure 3:
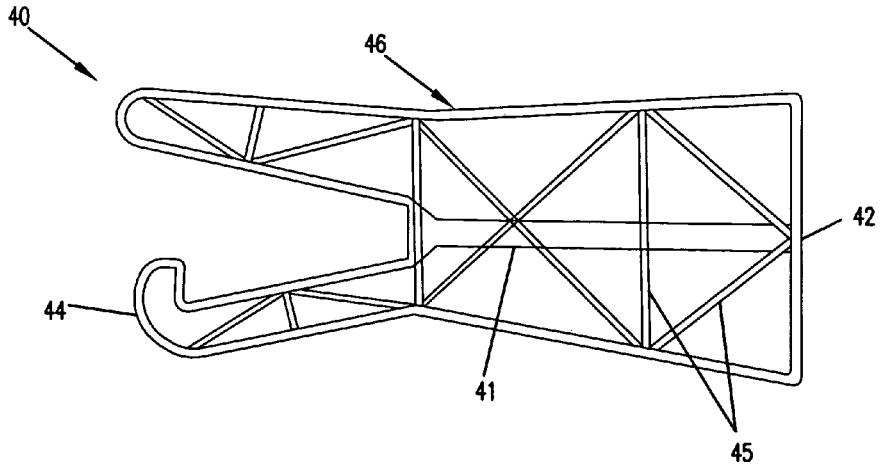
FIG. 3 is a side elevational view of a support member for the system shown in FIG. 1.

The gutter and cover system 10 of the present invention may also include a support member 40 extending under the cover portion 22 and lip the portion 20 of the front wall 19 for strengthening the gutter and cover system 10 against heavy rainfall, snow, ice and other natural elements. Support member 40 may be formed from metal, plastic or other suitable rigid material. As shown in FIG. 3, the support member 40 includes a first portion 46 engaging the underside of the cover portion 22, as shown in FIG. 1, a second portion 44 engaging the underside of the lip portion 20 of the front wall 19, and a third portion 42 engaging the rear wall 17 of the gutter and cover system 10. The support member may further include a plurality of bracing members, such as crossbeams 45, formed from metal, plastic or other suitable rigid material, to further strengthen the gutter and cover system 10. Preferably, the support member 40 also includes a mounting orifice 41 extending through the support member 40, wherein mounting hardware, such as nails, screws or similar fasteners, may extend through the orifice 41 to an opening in the rear wall 17 of the gutter system 10 and into the front of the structure 33. In this manner, the gutter system 10 is affixed with respect to the building structure 33 and the roof of the building structure. Support members 40 are positioned at spaced apart-predetermined distances along the gutter and cover system 10, with a typical spacing being about 2 feet.

FIGS. 4-7 illustrate further embodiments 50, 60, 70 and 80 of gutter and cover systems according to the present invention. A cover portion 22 includes a kinetic energy dispersion section 18 intermediate the rear wall 17 and the debris separation portion 12 that causes the water to pool and lose kinetic energy before flowing over the debris separation portion 12 and into the gutter portion 24. In addition, the alternative embodiments illustrated in FIGS. 4-7 may include a support member, similar to the support member 40, which extends under the cover portion and lip portion of the front wall of each of the embodiments.

Figure 8:
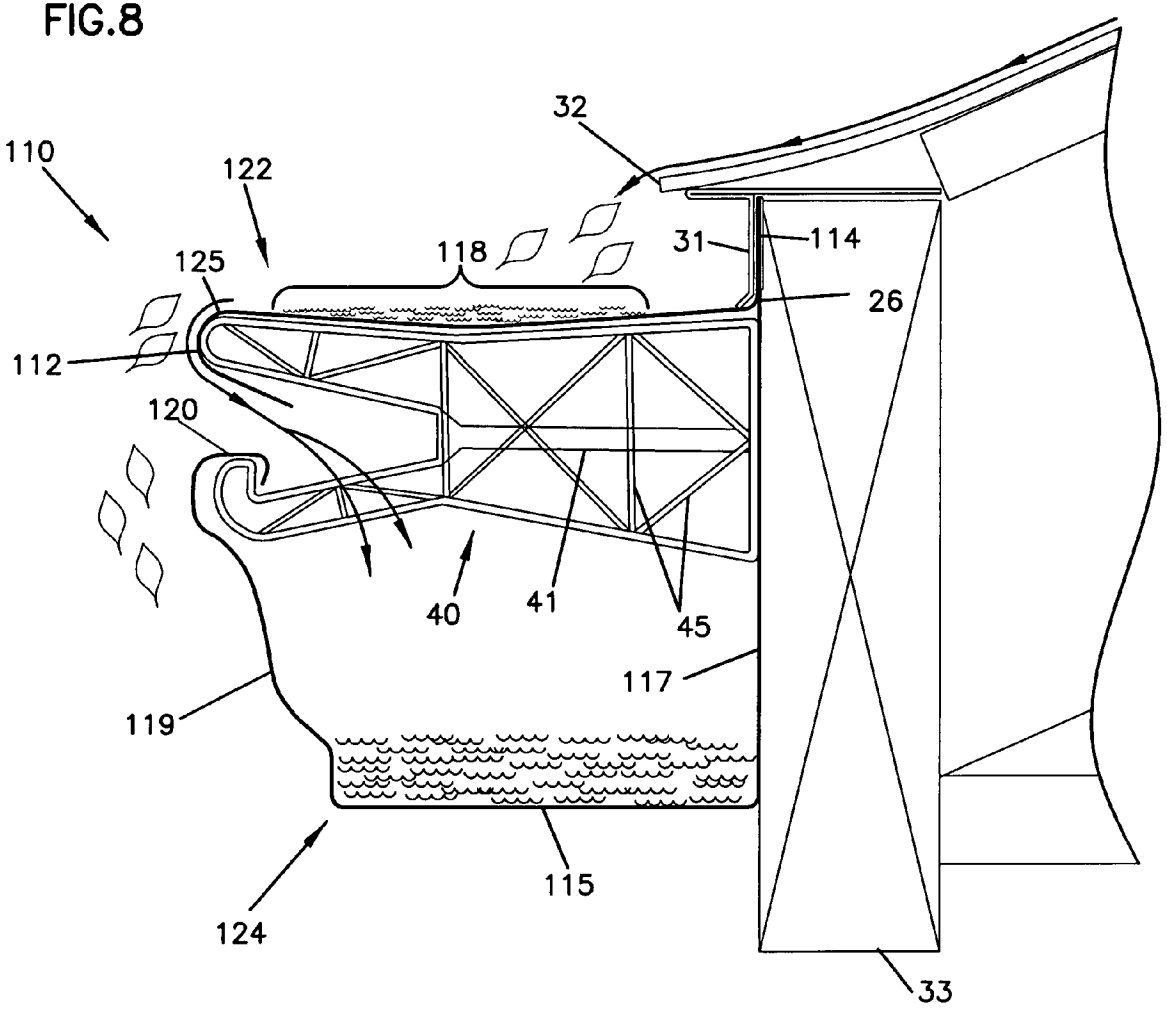
FIG. 8 is a side elevational view of a gutter and interlocked cover system according to the principles of the present invention.

Referring now to FIG. 8, there is shown another embodiment of gutter and cover system, generally designated 110. The gutter and cover system 110 is similar to the gutter and cover system 10 except that the gutter and cover are made of different elements that are interlocked as they are formed to achieve a unitary gutter and cover structure. The gutter and cover system 110 includes a rear wall 117, a gutter bottom 115 connecting to a front wall 114 and a lip portion 120, forming the gutter portion 124. The cover portion 122 includes a debris separation portion 112, an energy dispersion portion 118 and an extension 114, extending over the top of the rear wall 117. The extension 114 wraps around the upper end of the rear wall and is crimped together, as explained hereinafter, to form the interlocked gutter and cover structure 110. It can be appreciated that other profiles may also be utilized having an interlocked gutter portion 124 and cover portion 122 such as those shown in FIGS. 4-7. Moreover, it can be appreciated that different materials may be used for forming the gutter portion 124 and the cover portion 122. For example, the gutter 124 may be made of aluminum or steel while the cover 122 may be made of copper, for decorative purposes. The interlocked gutter and cover structure 110 may also include a brace 40 similar to that shown in FIG. 1.

Figure 9:
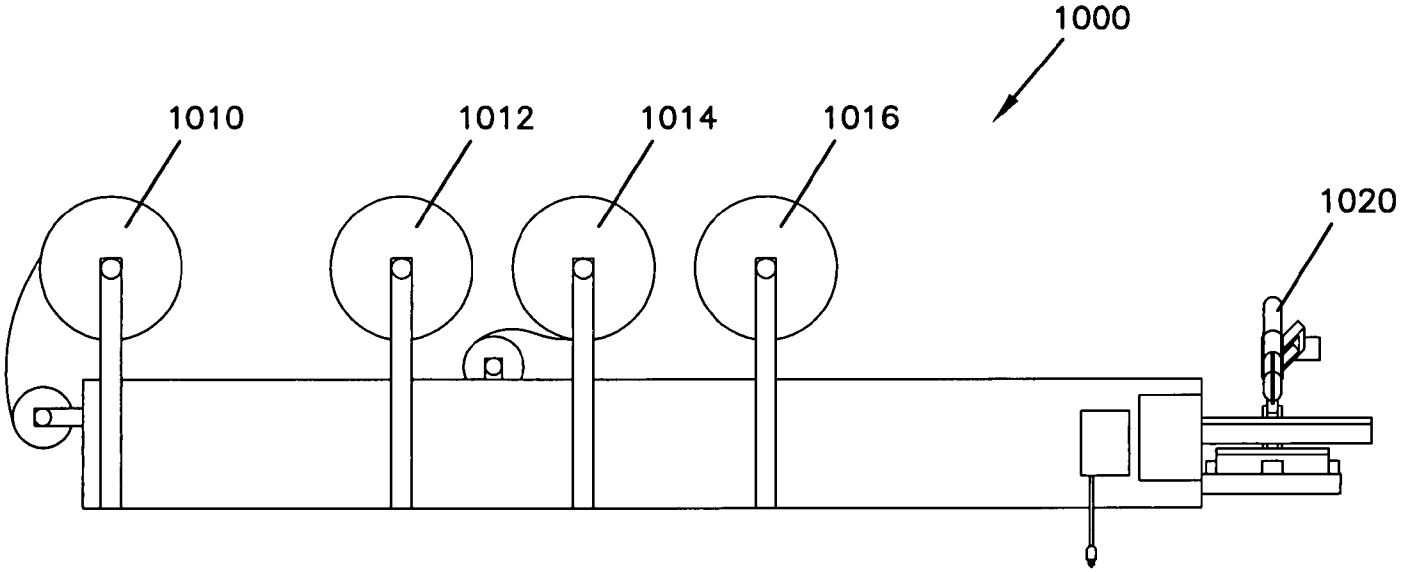
FIG. 9 is a side elevational view of a forming machine for making a gutter and cover system.
Figure 10:
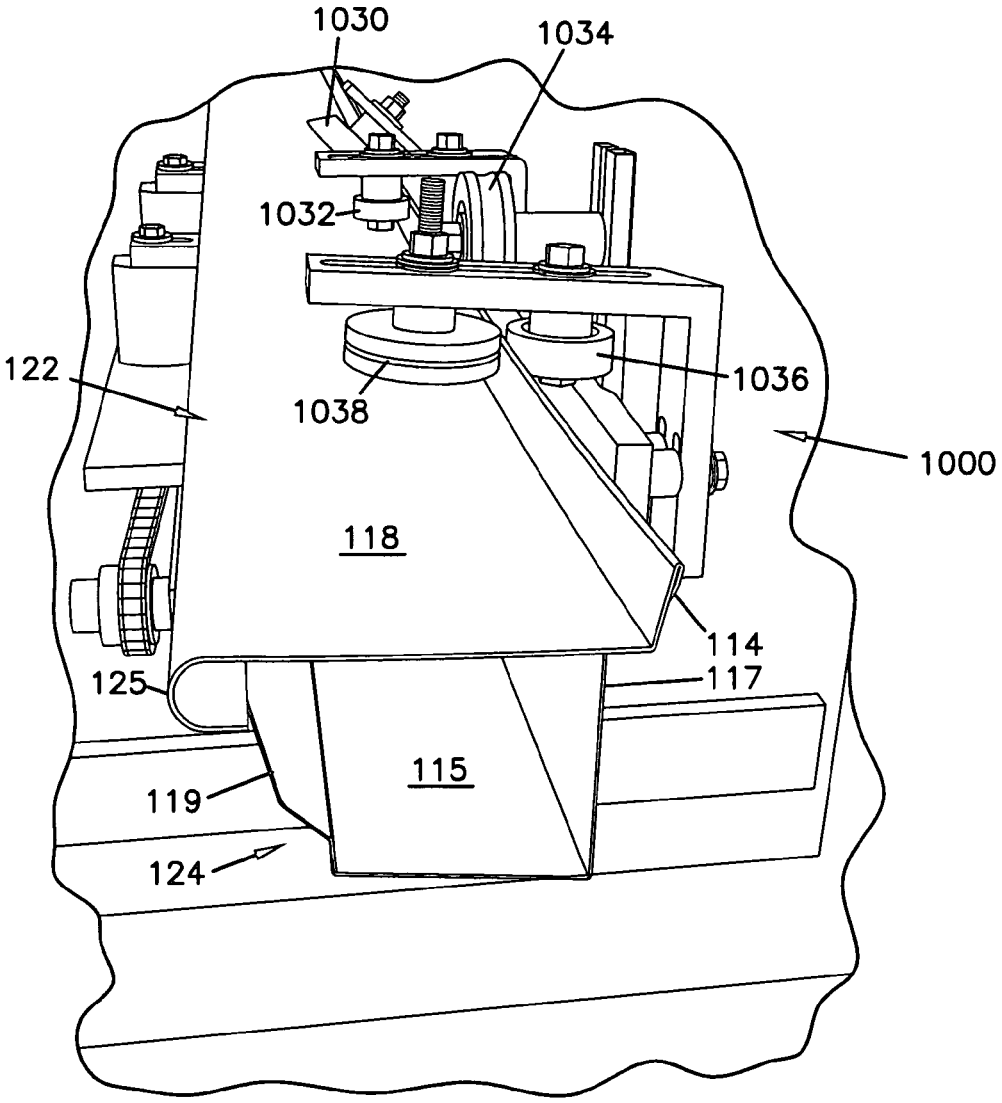
FIG. 10 is a detail view of the forming machine shown in FIG. 9 showing the rollers for forming an interlocked gutter and cover system.

Referring now to FIGS. 9 and 10, there is shown an apparatus 1000 for making the various gutter and cover systems shown in FIGS. 1-8. The gutter and cover forming apparatus 1000 includes a series of rollers for forming coils of blank material into a gutter and cover. Such roll forming devices are well known for making various gutters and cover systems from coils of material with a series of rollers successively forming the gutters. Examples of such roll forming devices are shown in U.S. Pat. No. 2,505,241 to Gray et al. and U.S. Pat. No. 4,889,566 to Knudson, which are incorporated herein by reference. The coils and material 1010, 1012, 1014 and 1016 may be fed to make the various types of gutters and cover structures shown in FIGS. 1-8. As shown, an end coil 1010 feeds material to the end of the gutter forming apparatus 1000 where the blank material is bent and shaped to form the gutter portion 124. A second coil of blank material 1014 is fed through another series of rollers to form the cover portion 122. These two elements are then joined, as shown in FIG. 10 to form a single seamless structure and as explained hereinafter. In addition, the forming apparatus 1000 may form the entire integral gutter and cover apparatus out of a coil of blank material such as 1012, which is wider than the blank material used for forming only the gutter portion. Moreover, a further coil 1016 may be utilized for other configurations of gutters or for a cover that may need a thinner or wider coil material. It can also be appreciated that the coils may hold different types of material. For example, some coils may be aluminum, some may be steel and some may be copper. The forming apparatus 1000 begins with a blank coil of material or blank coils of material and produces a seamless, single gutter and cover system that can be cut to length at a cutting station 1020 on site.

Referring now to FIG. 10, the forming apparatus 1000 may be configured for joining a cover portion 112 to a separate gutter portion 110, after they are formed with different series of forming rollers. The lip portion 114 is configured to slide over the upper end of the rear wall 117. These are pressed together and aligned by a guide roller 1030 and a pair of opposed guide rolls 1032. A press roll 1034 presses the lip portion 114 downward onto the upper end of the rear wall 117. An opposed punch roll and die roll 1036 and 1038 crimp and interlock the cover portion to the gutter portion to create an interlocked gutter and cover system 110. The structure is a single, seamless complete gutter and cover system that is then cut to length at the cutting station 1020, shown in FIG. 9.

It can be appreciated that the forming apparatus provides various options. A unitary gutter and cover system 10 may be formed or an interlocked gutter and cover system 110 may be formed on site. A gutter without a cover may also be formed and a cover without a gutter may be formed, depending upon the needs at the site. The apparatus 1020 is readily transported on a trailer so that on-site cutting to length may be possible, thereby avoiding seams and improving quality while saving labor and material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A seamless gutter and cover system comprising:

a gutter formed from a first coil of material having a front face, a bottom and a rear portion extending upward to a top segment;

a cover formed from a second coil of material, wherein the cover extends over the gutter and has a debris separation portion extending above the front face of the gutter, and a lip portion extending upward and wrapping over the top segment of the gutter;

wherein the top segment of the gutter and the flange portion of the cover are continuously crimped together along their entire length to interlock the top segment of the gutter with the flange portion of the cover.

* * * * *